US008032271B2

(12) United States Patent
Ito et al.

(10) Patent No.: US 8,032,271 B2
(45) Date of Patent: Oct. 4, 2011

(54) BOAT PROPULSION UNIT AND BOAT

(75) Inventors: Makoto Ito, Shizuoka (JP); Yoshikazu Nakayasu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 800 days.

(21) Appl. No.: 12/033,066

(22) Filed: Feb. 19, 2008

(65) Prior Publication Data

US 2008/0201031 A1 Aug. 21, 2008

(30) Foreign Application Priority Data

Feb. 19, 2007 (JP) ..... 2007-037989

(51) Int. Cl.
*G06F 17/00* (2006.01)

(52) U.S. Cl. ..... 701/21; 701/36; 701/51

(58) Field of Classification Search ..... 701/21, 701/29, 114, 36, 51; 440/61 T, 84–87; 477/111, 477/112; 74/473.1
See application file for complete search history.

(56) References Cited

U.S. PATENT DOCUMENTS 4,843,914 A 7/1989 Koike
6,470,852 B1 * 10/2002 Kanno ..... 123/339.23
6,942,530 B1 9/2005 Hall et al.
6,942,570 B2 * 9/2005 Schneier et al. ..... 463/17
7,214,164 B2 * 5/2007 Shomura et al. ..... 477/113
7,674,145 B2 * 3/2010 Okuyama et al. ..... 440/61 T
7,836,787 B2 * 11/2010 Oguma ..... 74/473.1
2005/0241425 A1 11/2005 Oguma

FOREIGN PATENT DOCUMENTS

EP 1 209 073 A1 5/2002

OTHER PUBLICATIONS

Official communication issued in counterpart European Application No. 08002868.1, mailed on May 28, 2008.

* cited by examiner

*Primary Examiner* — Richard M. Camby
(74) *Attorney, Agent, or Firm* — Keating & Bennett, LLP

(57) ABSTRACT

A boat is capable of preventing shocks on gears in meshing engagement with each other and an abrupt movement thereof when a remote control shift lever is quickly rotated to reverse from a cruising mode. A control microcomputer is arranged to control the operation of a shift actuator based on the displacement of a remote control shift lever for remotely switching between forward, neutral, and reverse positions. The control microcomputer has a shift detector arranged to detect whether a shift operation from the neutral position to the forward position or the reverse position was made based on a signal from a lever position sensor arranged to detect the position of the remote control shift lever; and a switch control which does not drive a shift motor when a shift operation from the neutral position to the forward position or the reverse position is detected by the shift detector and the engine rotational speed detected by the engine rotational speed sensor is higher than a prescribed value, and drives the shift motor and controls a shift operating device to start shifting when the engine rotational speed decreases to a value equal to or smaller than the prescribed value.

32 Claims, 9 Drawing Sheets

BOAT PROPULSION UNIT AND BOAT

BACKGROUND OF THE INVENTION

1. Field of the Invention

The present invention relates to a boat propulsion unit and a boat having the boat propulsion unit in which shifting between forward, neutral, and reverse is electrically performed by remote control.

2. Description of the Related Art

One conventional boat of this type is disclosed in JP-A-2005-297785.

It is described in JP-A-2005-297785 that a shift device includes a remote control operation device having a remote control shift lever for remotely shifting between forward, neutral, and reverse; a boat propulsion unit having a shifting device for shifting between forward, neutral, and reverse, and a shift actuator for driving the shifting device; and a controller for controlling the operation of the shift actuator based on the displacement of the remote control shift lever when the remote control shift lever is operated within a prescribed shift range from a neutral position; wherein the controller controls the operation amount of the actuator with respect to a unit displacement of the remote control shift lever such that it is different in different sections of the shift range.

However, in such a conventional device, when the remote control shift lever is quickly rotated to reverse from an advancing mode to make a shift-in in the opposite direction, a shift-in to reverse is done before the engine rotational speed and the boat speed are sufficiently reduced. Then, a shock at that time may be exerted on the gears in meshing engagement with each other and the boat may have an abrupt movement.

That is, when the remote control shift lever is quickly rotated to reverse from a forward mode to make a shift-in in the opposite direction, since a force urges the propeller to rotate in the opposite direction while the propeller is still rotating in the forward direction and an inertia force in that direction is generated, a large force is generated between the gears on the propeller side and the gears on the engine side. Then, a shock at that time may be exerted on the gears, and the boat may have an abrupt movement.

SUMMARY OF THE INVENTION

In order to overcome the problems described above, preferred embodiments of the present invention provide a boat capable of preventing shocks to gears in meshing engagement with each other and an abrupt movement thereof even when the remote control shift lever is quickly rotated to reverse from a forward cruising mode.

A boat propulsion unit according to a preferred embodiment of the present invention includes a shift operating device arranged to shift between forward, neutral, and reverse according to an operation signal from a remote control; a shift actuator arranged to drive the shift operating device; an engine arranged to rotate a propeller; and a controller which receives an operation signal from the remote control and controls operation of the shift actuator, wherein when the controller receives the operation signal from the remote control and the operation signal is a signal commanding a shift operation from the neutral position to the forward position or the reverse position, the controller drives the shift actuator to shift from the neutral position to the forward position or the reverse position when at least one of the engine rotational speed, boat speed, and propeller shaft rotational speed is equal to or lower than a prescribed value therefor.

Preferably, the controller drives the shift actuator to shift from the neutral position to the forward position or the reverse position when both the engine rotational speed and the boat speed or the propeller shaft rotational speed are equal to or lower than the respective prescribed values.

Preferably, when the controller receives an operation signal from the remote control and the operation signal is a signal commanding a shift operation from the forward position through the neutral position to the reverse position, or vice-versa, the controller drives the shift actuator to shift from the neutral position to the forward position or the reverse position when at least one of the engine rotational speed, boat speed, and propeller shaft rotational speed is equal to or lower than a prescribed value therefor.

Preferably, the controller does not drive the shift actuator when the throttle opening is equal to or greater than a prescribed value even when at least one of the engine rotational speed, the boat speed, and the propeller shaft rotational speed is equal to or lower than the prescribed value therefor, and does drive the shift actuator to shift from the neutral position to the forward position or the reverse position when the throttle opening becomes smaller than the prescribed value.

Preferably, a failure detector is provided to detect a failure of a sensor arranged to detect the engine rotational speed, the boat speed, or the propeller shaft rotational speed, and when a failure is detected, the shift actuator is driven according to the operative position of the remote control shift lever to accomplish normal shifting by the shift operating device even when a shift operation from the neutral position to the forward position or the reverse position is detected.

Another preferred embodiment of the present invention includes a shift operating device arranged to shift between forward, neutral, and reverse according to an operation signal from a remote control; a shift actuator arranged to drive the shift operating device; an engine arranged to rotate a propeller; and a controller which receives an operation signal from the remote control and controls operation of the shift actuator, wherein when the controller receives the operation signal from the remote control and the operation signal is a signal commanding a shift operation from the neutral position to the forward position or the reverse position, the controller drives the shift actuator to shift from the neutral position to the forward position or the reverse position when the engine rotational speed is equal to or lower than a prescribed value, and a prescribed value of the engine rotational speed can be changed depending on the boat speed and is controlled to be a greater value when the boat speed is high than when the boat speed is low.

Preferably, the boat speed is estimated and calculated from the intake pressure to the engine and the engine rotational speed.

Another preferred embodiment of the present invention includes a throttle valve and a throttle actuator arranged to open and close the throttle valve, a throttle control device arranged to control operation of the throttle actuator, and a shift detector arranged to detect completion of shifting, wherein the throttle control device controls the throttle actuator not to operate until the shifting is completed.

Another preferred embodiment of the present invention includes a boat provided with a boat propulsion unit as described above.

Another preferred embodiment includes a boat having a plurality of boat propulsion units, wherein at least one of the plurality of boat propulsion units is a boat propulsion unit as described above.

According to a preferred embodiment described above, when the controller receives the operation signal from the remote control and the operation signal is a signal commanding a shift operation from the neutral position to the forward position or the reverse position, the controller drives the shift actuator to shift from the neutral position to the forward position or the reverse position when at least one of the engine rotational speed, boat speed, and propeller shaft rotational speed is equal to or lower than a prescribed value therefor. Therefore, a shift-in at a time when the engine rotational speed, the boat speed, or the propeller shaft rotational speed is higher than the prescribed value therefor can be avoided, and shocks on gears in meshing engagement with each other and an abrupt movement of the boat can be prevented.

According to a preferred embodiment described above, the shift actuator is driven to shift from the neutral position to the forward position or the reverse position when both the engine rotational speed and the boat speed or the propeller shaft rotational speed are equal to or lower than the respective prescribed values. Therefore, appropriate control can be accomplished as compared to the case where control is performed based on whether one of the engine rotational speed, the boat speed, or the propeller shaft rotational speed is higher than the prescribed value therefor.

According to a preferred embodiment described above, when the controller receives an operation signal from the remote control and the operation signal is a signal commanding a shift operation from the forward position through the neutral position to the reverse position, or vice-versa, the controller drives the shift actuator to shift from the neutral position to the forward position or the reverse position when at least one of the engine rotational speed, boat speed, and propeller shaft rotational speed is equal to or lower than a prescribed value therefor. Performing shift control in the above-described case is effective since shocks on gears are particularly large when a shift operation from the forward position through the neutral position to the reverse position, or vice-versa, is done.

According to a preferred embodiment described above, the controller does not drive the shift actuator when the throttle opening is equal to or greater than a prescribed value even when at least one of the engine rotational speed, the boat speed, and the propeller shaft rotational speed is equal to or lower than the prescribed value therefor, and does drive the shift actuator to shift from the neutral position to the forward position or the reverse position when the throttle opening becomes smaller than the prescribed value. Even when at least one of the engine rotational speed, the boat speed, and the propeller shaft rotational speed is equal to or lower than a prescribed value therefor, the engine rotational speed of the engine may rapidly increase after shifting if the throttle is opened. With the above-described configuration, however, a shift-in in such a case can be avoided. As a result, shocks on the gears and an abrupt movement of the boat can be prevented.

According to a preferred embodiment described above, a failure detector arranged to detect a failure of a sensor detecting the engine rotational speed, and the boat speed or the propeller shaft rotational speed is provided, and, when a failure is detected, the shift actuator is driven according to the operative position of the remote control shift lever to accomplish normal shifting by the shift operating device even when a shift operation from the neutral position to the forward position or the reverse position is detected. Therefore, even if the sensor detecting the engine rotational speed has failed and cannot measure the engine rotational speed, a minimum shift driving operation can be carried out. For example, even when the sensor has failed and the engine rotational speed is detected as not having decreased to a value lower than the prescribed value although the engine rotational speed has decreased to a value lower than the prescribed value in reality, a normal shift driving operation can be carried out.

According to a preferred embodiment described above, the prescribed value of the engine rotational speed can be changed depending on the boat speed and is controlled to a greater value when the boat speed is high than when the boat speed is low. Therefore, since the prescribed value of the engine rotational speed is increased to a larger value when the boat speed is low, frequent shift-in or shift-out for adjustment of the boat position required to drive the boat ashore can be accomplished reliably.

According to a preferred embodiment described above, the boat speed is estimated and calculated from the intake pressure to the engine and the engine rotational speed. Therefore, the boat speed can be estimated and the operation described above can be carried out even when the boat speed sensor is not connected or the boat speed sensor has failed.

According to another preferred embodiment of the present invention, a throttle actuator arranged to open and close the throttle valve; a throttle control device arranged to control operation of the throttle actuator; and a shift detector arranged to detect completion of shifting are provided, and the throttle control device controls the throttle actuator not to operate until the shifting is completed. Therefore, a quick increase in the engine rotational speed during shifting can be prevented, and a shift-in at a high engine rotational speed condition can be avoided. As a result, damage of a reverse gear, etc. and a rapid movement of the boat can be prevented.

According to another preferred embodiment described above, a boat is provided with one or more boat propulsion units having the above-described features and advantages.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Description is hereinafter made of preferred embodiments of the present invention.

First Preferred Embodiment

FIG. 1 to FIG. 9 show a first preferred embodiment of the present invention.

Figure 1:
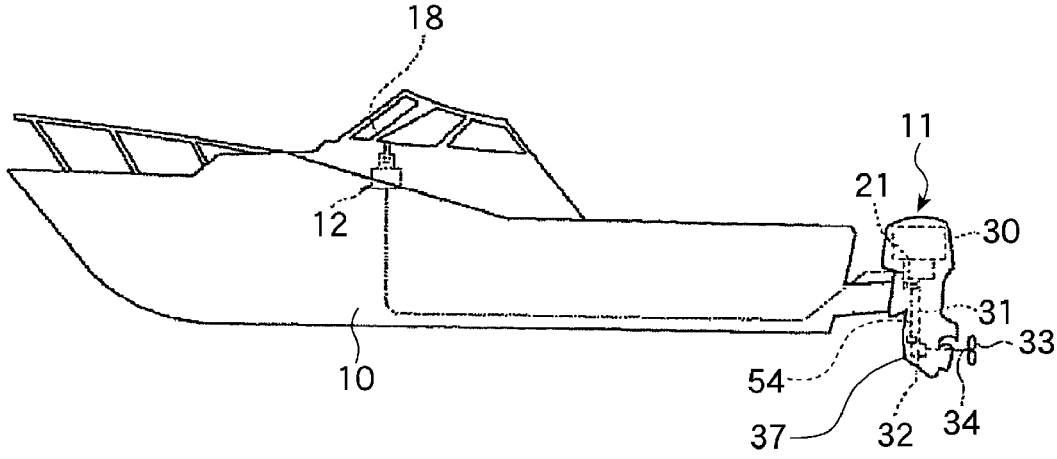
FIG. 1 is a side view of a boat according to a first preferred embodiment of the present invention.
Figure 2:
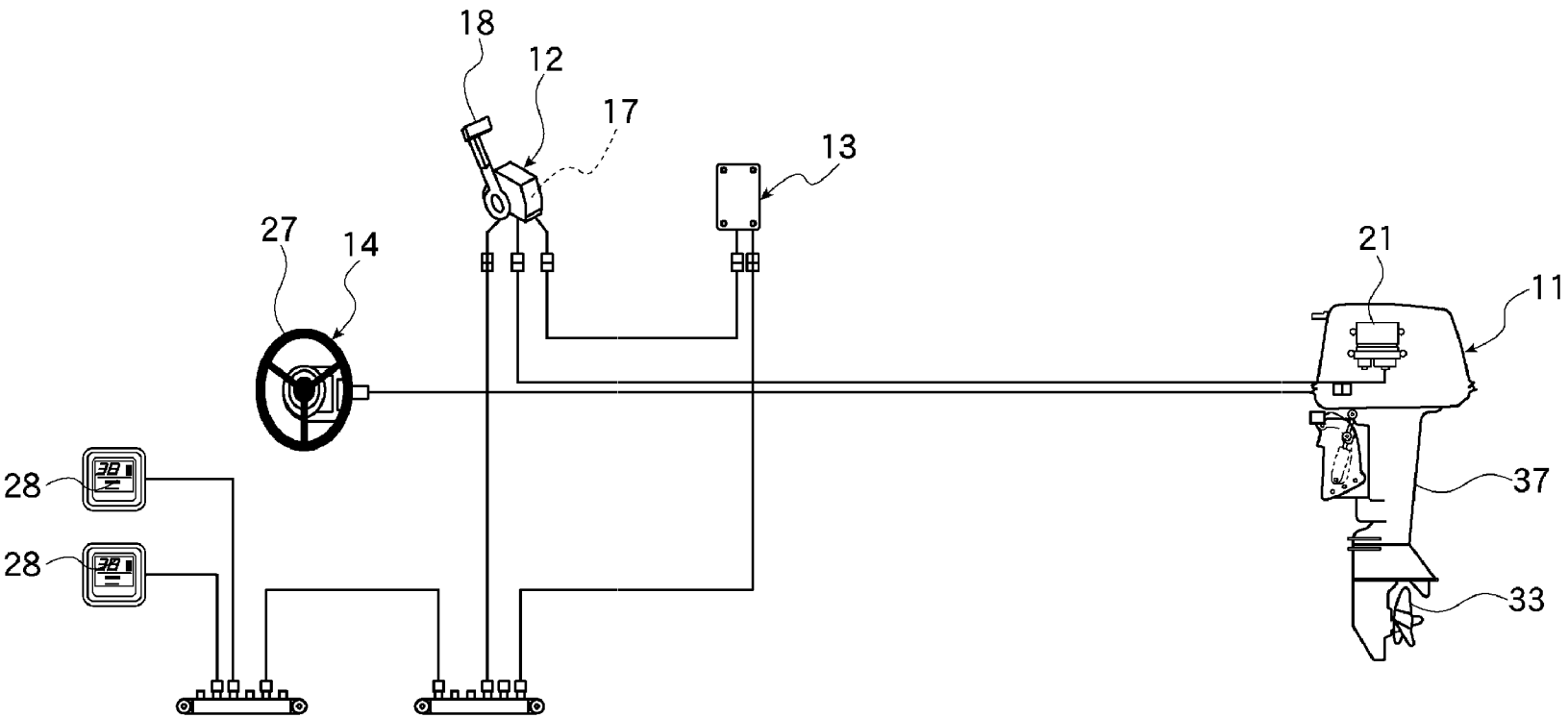
FIG. 2 is a block diagram illustrating the connection state of a remote control operation device, an outboard motor, and so on of the boat according to the first preferred embodiment of the present invention.

As shown in FIG. 1 and FIG. 2, a boat according to a preferred embodiment has an outboard motor 11 as a boat propulsion unit attached to the stern of the boat's hull 10. The outboard motor 11 is controlled to steer the boat by a remote control operation device 12, a key switch device 13, a steering wheel device 14, and soon arranged in the cockpit on the hull 10.

Figure 5:
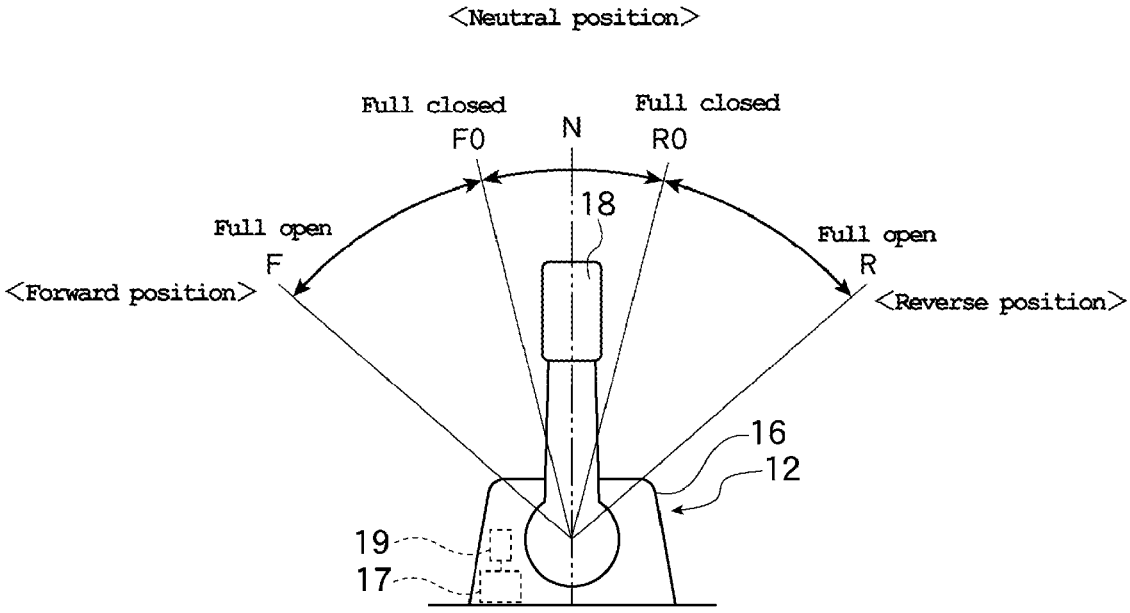
FIG. 5 is a side view illustrating a remote control shift lever of the boat according to the first preferred embodiment of the present invention.

The remote control operation device 12 has a remote control body 16 (see FIG. 5) in which a remote control side ECU 17 is housed, and a remote control shift lever 18 for throttle and shift operations. Shifting between forward, neutral, and reverse is remotely done by the remote control shift lever 18. As shown in FIG. 5, the center position, at which the remote control shift lever 18 stands vertically, is the neutral position (N), and the position at which the remote control shift lever 18 is rotated forward by a prescribed angle from the center position and the position at which the remote control shift lever 18 is rotated backward by a prescribed angle from the center position are the forward position (F) and the reverse position (R), respectively. The operation information including the speed at which the remote control shift lever 18 is operated and the angle through which the remote control shift lever 18 is operated is detected by a potentiometer 19 as a lever position sensor and transmitted to the remote control side ECU 17. In other words, the position of the remote control shift lever 18 is detected by the potentiometer 19.

Figure 6:
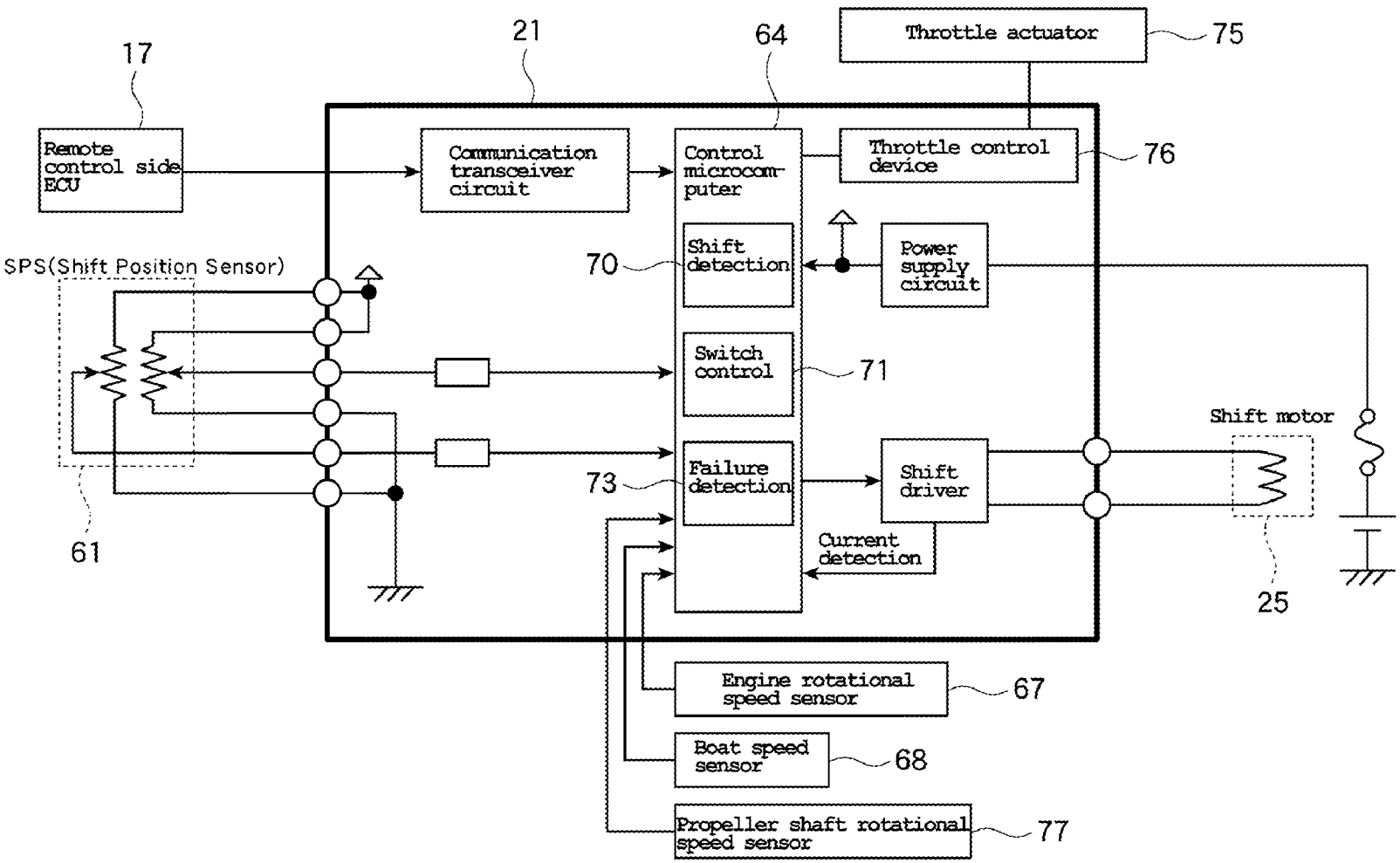
FIG. 6 is a block diagram illustrating a remote control side ECU, an engine side ECU, and so on of the boat according to the first preferred embodiment of the present invention.

A signal from the remote control side ECU 17 is transmitted to an engine side ECU 21 of the outboard motor 11 as shown in FIG. 6. The engine side ECU 21 controls the drive of the shift motor 25 of a shift actuator 22 based on the displacement of the remote control shift lever 18, and a shift operating device 23 is actuated by the shift actuator 22 to shift between forward, neutral, and reverse.

The key switch device 13 is connected to the remote control side ECU 17 of the remote control operation device 12 as shown in FIG. 2. The key switch device 13 has a starter switch and a main/stop switch, although not shown.

The steering wheel device 14 is provided therein with a steering wheel side ECU (not shown) and has a steering wheel 27 for steering the boat. The steering wheel position is detected by a position sensor, which is connected to the steering wheel side ECU via a signal circuit.

The steering wheel side ECU of the steering wheel device 14 is preferably connected to the engine side ECU 21 of the remote control operation device 12 via a DBWCAN cable as a signal line. Here, DBW stands for Drive-By-Wire, which is a control device that uses an electrical connection instead of a mechanical connection, and CAN stands for "Controller Area Network." Gauges 28 are connected to the remote control operation device 12 and the key switch device 13, as shown in FIG. 2.

The engine 30 is located in an upper portion of the outboard motor 11 as shown in FIG. 1, and the output of the engine 30 is transmitted via a drive shaft 31 and a shift device 32 to a propeller shaft 34 to which a propeller 33 is fixed.

Shifting between forward, neutral, and reverse in the shift device 32 is done by the shift operating device 23, and the shift operating device 23 is driven by the shift actuator 22.

Figure 3:
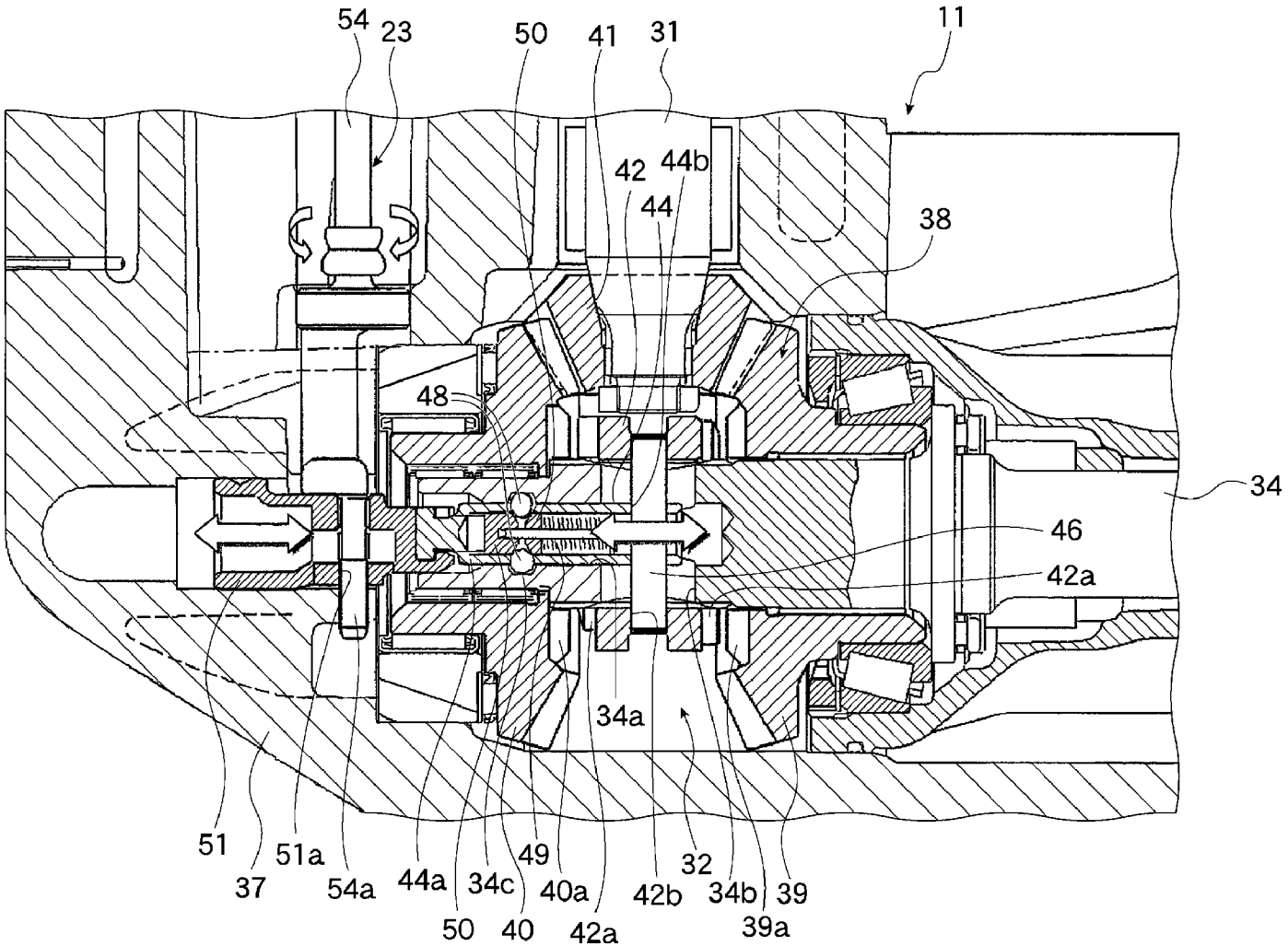
FIG. 3 is a cross-sectional view of a shift device of the boat according to the first preferred embodiment of the present invention.

More specifically, the outboard motor 11 has a propeller shaft 34 extending generally horizontally in a casing 37 and a propeller 33 attached to the propeller shaft 34 as shown in FIG. 1 to FIG. 3. The propeller shaft 34 is connected to the driveshaft 31 via a gear mechanism 38 for switching between forward and reverse modes, that is, for shifting.

The gear mechanism 38 has a forward gear 39 and a reverse gear 40 rotatably mounted on the propeller shaft 34. The gears 39 and 40 are both in meshing engagement with a pinion 41 fixed to the driveshaft 31, which is driven to rotate clockwise as viewed from above, so as to rotate in opposite directions.

A forward gear 39 and a reverse gear 40 are located on the rear side and front side, respectively, with respect to the forward direction of the boat (left in FIG. 3).

A sleeve-shaped dog clutch 42 is splined on the propeller shaft 34 between the gears 39 and 40, and the dog clutch 42 is slidable in the axial direction of the propeller shaft 34. The dog clutch 42 has radially extending claws 42*a*. The gears 39 and 40 have claws 39*a* and 40*a*, respectively, facing the claws 42*a*. The claws collectively define a claw clutch.

The propeller shaft 34 has an insertion hole 34*a* arranged in its front end along the axial direction thereof and is open at the front end, and a shift sleeve 44 is received in the insertion hole 34*a* for sliding movement in the axial direction. A slot 34*b* elongated in the axial direction is provided through the peripheral wall of the insertion hole 34*a* of the propeller shaft 34.

The shift sleeve 44 and the dog clutch 42 have through-holes 44*b* and 42*b*, respectively, extending in a diameter direction thereof, and a pin 46 is inserted in the through-hole 42*b* of the dog clutch 42, the slot 34*b* of the propeller shaft 34, and the through-hole 44*b* of the shift sleeve 44.

Therefore, when the shift sleeve 44 moves, the pin 46 is moved in the axial direction within the slot 34*b*, and the dog clutch 42 is moved in the axial direction of the propeller shaft 34 via the pin 46.

The shift sleeve 44 has detent balls 48 retractably protruding from the outer peripheral surface of the shift sleeve 44 and removably engageable with recesses 34*c* of the propeller shaft 34. The detent balls 48 are urged in the protruding direction by a spring 49 and a pressing member 50.

The shift sleeve 44 has a front end 44*a* to which a shifter 51 slidable to the right and left as viewed in FIG. 3 is connected, and the shifter 51 has an engaging groove 51*a* extending vertically.

At the lower end of a shift shaft 54 of the shift operating device 23, a drive pin 54*a* located in a position offset in a crank fashion with respect to the axis of rotation of the shift shaft 54 is received in the engaging groove 51*a*. When the drive pin 54*a* is rotated eccentrically by rotation of the shift shaft 54, the shifter 51 slides to slide the dog clutch 42.

When the shift shaft 54 is rotated in one direction, the dog clutch 42 is slid in one direction. When the shift shaft 54 is rotated in the opposite direction, the dog clutch 42 is slid in the opposite direction.

Figure 4:
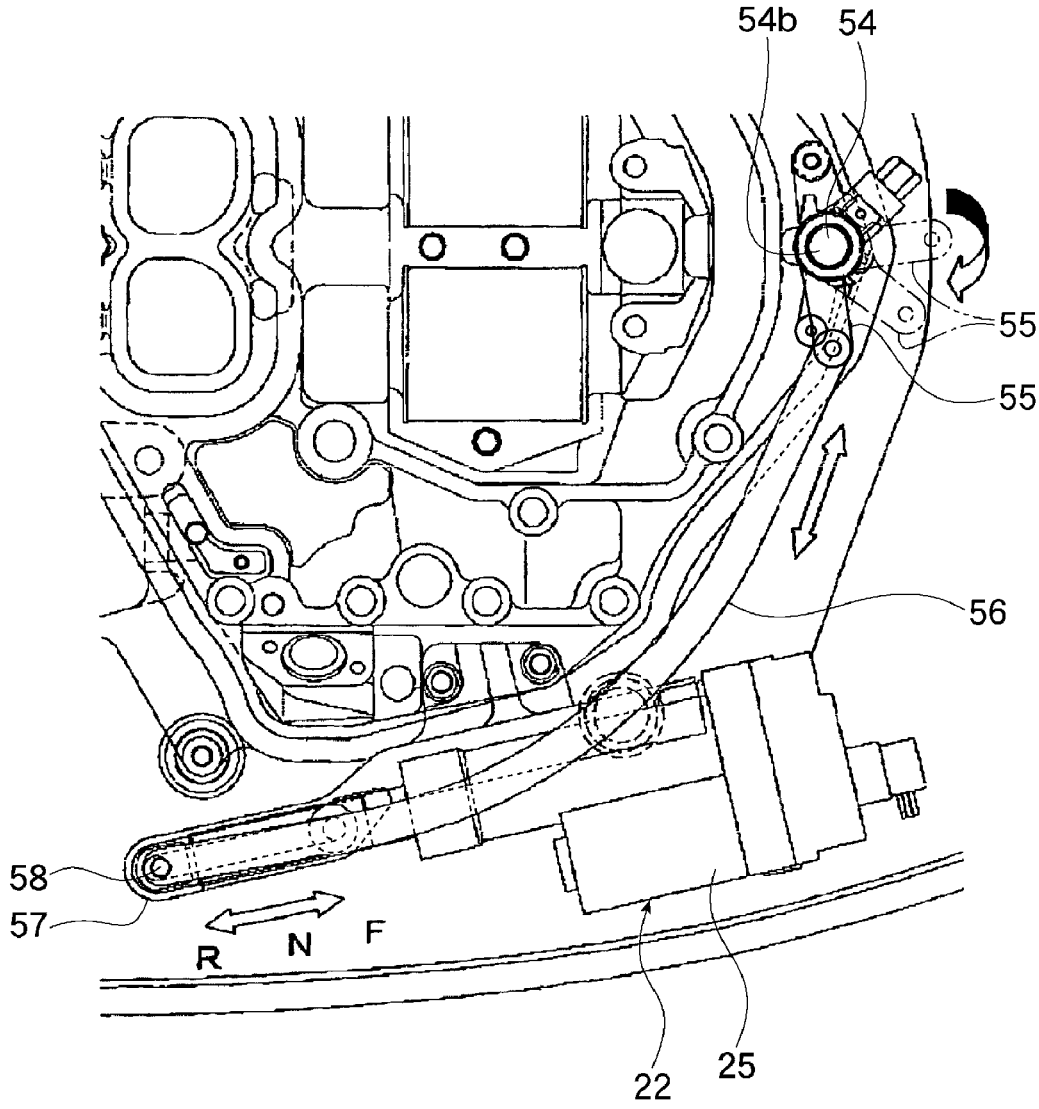
FIG. 4 is a plan view illustrating a shift actuator and so on of the boat according to the first preferred embodiment of the present invention.

The shift shaft 54 extends vertically, and, as shown in plan view in FIG. 4, has an upper end 54*b* to which a lever 55 is secured. One end of a lever shift rod 56 is rotatably connected to the distal end of the lever 55, and the other end of the lever shift rod 56 is rotatably connected to a slider 58 slidably mounted on a shift rail 57. When the slider 58 is slid in a prescribed direction by the shift actuator 22, the shift shaft 54 is rotated in a prescribed direction via the lever shift rod 56 and the lever 55.

The shift actuator 22 has a shift motor 25 that is preferably a DC motor as a driving source, a reduction mechanism (not shown) and so on, and is configured to drive the slider 58 in a prescribed direction.

As shown in FIG. 6, the shift actuator 22 has a shift position sensor (SPS) 61 arranged to detect the shift position (forward position, neutral position, or reverse position) and the shift speed. A signal from the shift position sensor 61 is inputted into a control microcomputer 64 of the engine side ECU 21.

An engine rotational speed sensor (for example, a crankshaft sensor or camshaft sensor) 67 arranged to detect the rotational speed of the engine 30, a boat speed sensor (for example, a water pressure sensor or paddle wheel type sensor) 68 arranged to detect the boat speed, and a propeller shaft rotational speed sensor 77 arranged to detect the rotational speed of the propeller shaft 34 are provided. An engine rotational speed signal, a boat speed signal, and a propeller shaft rotational speed signal from the sensors 67, 68, and 77 are inputted into the control microcomputer 64.

When the remote control shift lever 18 is operated within a prescribed shift range, the control microcomputer 64 controls the operation of the shift actuator 22 based on the displacement of the remote control shift lever 18.

More specifically, the control microcomputer 64 has a shift detector 70 arranged to detect whether a shift operation from the forward position through the neutral position to the reverse position or vice versa, was made based on a signal from the potentiometer 19 arranged to detect the position of the remote control shift lever 18, and a switch controller 71 arranged to stop or start shift switch driving.

The switch controller71 does not drive the shift actuator 22 when the shift detector 70 detects a shift operation from the forward position through the neutral position to the reverse position, or vice-versa, and the value of the engine rotational speed detected by the engine rotational speed sensor 67 is higher than a prescribed value, and does drive the shift actuator 22 and controls the shift operating device 23 to start shift switch driving to the reverse position or forward position when the engine rotational speed decreases to a value equal to or smaller than the prescribed value.

The switch controller 71 does not drive the shift actuator 22 when the throttle opening is equal to or greater than a certain value even when the engine rotational speed is lower than the prescribed value, and does drive the shift actuator 22 and controls the shift operating device 23 to start the shift switch driving when the throttle opening decreases to a value equal to or smaller than the certain value.

In addition, a failure detector 73 arranged to detect a failed state of the engine rotational speed sensor 67 is provided, and a failure detection signal from the failure detector 73 is inputted into the switch controller71. The failure detector 73 determines whether or not the engine rotational speed sensor 67 has failed by detecting an abnormal signal from the engine rotational speed sensor 67.

When a failure detection signal is inputted into the switch controller71, the switch controller 71 drives the shift actuator 22 according to the operative position of the remote control shift lever 18 so that normal shift switch driving by the shift operating device 23 can be made even when the shift detector 70 detects a shift operation of the remote control shift lever 18 from the forward position through the neutral position to the reverse position, or vice-versa, and the engine rotational speed is higher than a prescribed value (the value is not accurate because of the failure).

Thus, even if the engine rotational speed sensor 67 arranged to detect the engine rotational speed has failed and cannot measure the engine rotational speed, a minimum shift driving operation can be carried out. For example, even when the engine rotational speed sensor 67 has failed and the engine rotational speed is detected as not having decreased to a value lower than the prescribed value although the engine rotational speed has decreased to a value lower than the prescribed value in reality, a normal shift driving operation can be carried out.

The boat speed may be estimated or calculated from the intake pressure to the engine 30 and the engine rotational speed.

In this case, the boat speed can be estimated even when the boat speed sensor 68 is not connected or the boat speed sensor 68 has failed.

When the engine 30 is being driven with the remote control shift lever 18 in the forward position and when the boat is traveling forward, the operation information including the speed at which the remote control shift lever 18 is operated and the angle through which the remote control shift lever 18 is operated is detected by the potentiometer 19 and transmitted to the engine side ECU 21 via the remote control side ECU 17 to detect the position of the remote control shift lever 18.

Figure 7:
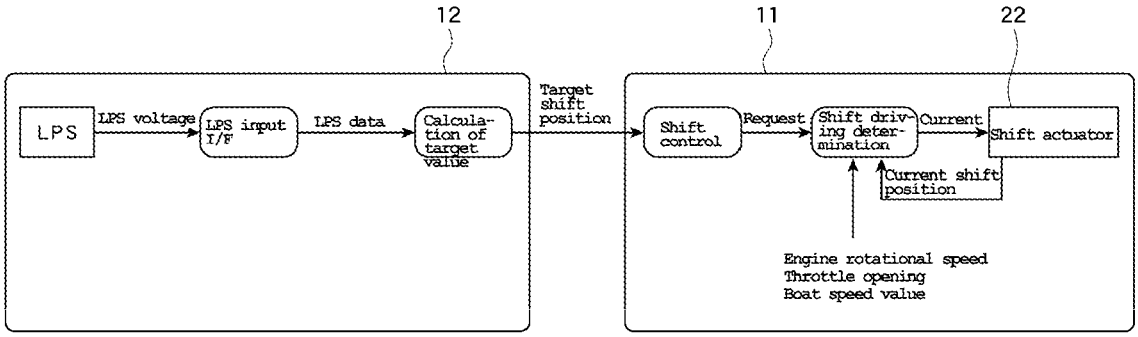
FIG. 7 is a view illustrating a control process flow of the boat according to the first preferred embodiment of the present invention.

When the remote control shift lever 18 is rotated backward from the forward position through the neutral position to the reverse position in this state, the position of the remote control shift lever 18 is detected by the potentiometer 19, inputted into the remote control side ECU 17 of the remote control operation device 12, and converted into a lever position voltage (LPS voltage) as shown in FIG. 7.

The lever position voltage is inputted into an interface (I/F) and converted therein into lever position data, and a target value is calculated based on the lever position data (LPS data). The target value is then converted into a target shift position signal, which is in turn inputted into the control microcomputer 64 of the engine side ECU 21 and subjected to shift control. A request from the shift control is subjected to shift driving determination by the switch controller 71, and a prescribed current is inputted into the shift actuator 22, whereby the shift motor 25 of the shift actuator 22 is driven in a prescribed direction at a prescribed speed.

The current shift position of the shift actuator 22 is detected by the shift position sensor 61 and provided to the shift controller as a feedback, and a feedback control is performed to shift it to a desired position.

When the shift motor 25 of the shift actuator 22 is driven, the dog clutch 42 is slid in a prescribed direction via the slider 58, the lever shift rod 56, the shift shaft 54, the shifter 51, the shift sleeve 44, the pin 46, and so on. Then, either of the claws 42*a* of the dog clutch 42 is brought into engagement with the claws 39*a* of the forward gear 39 or the claws 40*a* of the reverse gear 40 to accomplish shift-in switching.

Figure 8:
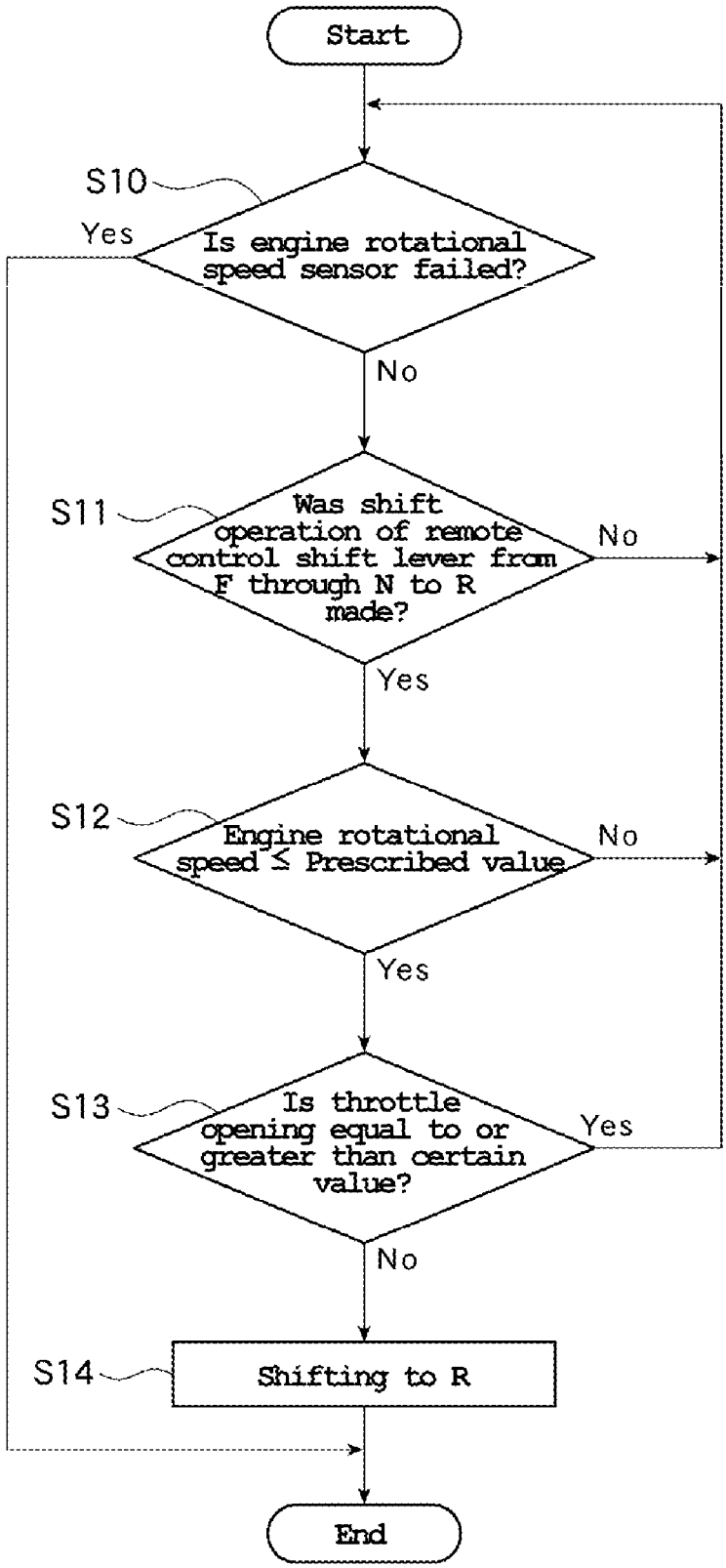
FIG. 8 is a flowchart for operating the boat according to the first preferred embodiment of the present invention.

At the time of such shifting, a control process as shown in FIG. 8 is performed. First, it is determined whether or not the engine rotational speed sensor 67 has failed in step S10. If the engine rotational speed sensor 67 has failed, the control is terminated without performing the shift control of the present preferred embodiment. If the engine rotational speed sensor 67 has not failed, the process goes to step S11.

In step S11, a signal from the potentiometer 19 is inputted into the shift detector 70, and it is determined by the shift detector 70 whether the shift operation of the remote control shift lever 18 from the forward position through the neutral position to the reverse position, or vice-versa, has been made. If not, the process returns to step S10. If it is determined that the remote control shift lever 18 has moved from the forward position through the neutral position to the reverse position, or vice-versa, the process goes to step S12.

In step S12, a signal of the value of the engine rotational speed detected by the engine rotational speed sensor 67 is inputted into the switch controller 71, and it is determined whether or not the engine rotational speed is lower than a prescribed value (1500 rpm, for example). If it is determined that the engine rotational speed is higher than the prescribed value ("NO"), the process returns to step S10 and the switch controller 71 does not drive the shift actuator 22 even when a shift operation of the remote control shift lever 18 from the forward position through the neutral position to the reverse position, or vice-versa, has been made.

Therefore, even when the remote control shift lever 18 is rotated from the forward position through the neutral position to the reverse position, for example, in a high engine rotational speed state, since actual shift switch driving by the shift operating device 23 is not carried out, no shock is applied between the reverse gear 40, the pinion 41, and the dog clutch 42. As a result, damage of the reverse gear 40, etc., and a rapid movement of the boat can be prevented.

That is, in a conventional boat propulsion unit, when the remote control shift lever 18 is quickly rotated toward reverse to shift-in into the opposite direction from a forward mode, a large force is applied to the propeller which urges it to rotate in the opposite direction while the propeller is still rotating in the forward direction and inertia forces are generated. In the present preferred embodiment, however, since a control process is performed as described above, no shock is applied. Therefore, damage of the reverse gear, 40 etc., and a rapid movement of the boat can be prevented.

Since no actual shift switch driving from the neutral position to the reverse position is performed, the shift position is maintained in the neutral position state and the engine rotational speed decreases. After that, when the engine rotational speed becomes equal to or lower than a prescribed value, it is determined that the engine rotational speed is lower than a prescribed value in step S12, and the process goes to step S13.

It is a matter of course that when the engine rotational speed is lower than the prescribed value, the process does not return to step S10 but goes to step S13 from step S12.

In step S13, a signal of the throttle opening from a throttle opening sensor (not shown) is inputted into the switch controller 71, and it is determined whether or not the throttle opening is equal to or larger than a certain value. If "YES," the process returns to step S10, and shift driving is not performed immediately. If "NO," the process goes to step S14. In step S14, the switch controller 71 drives the shift actuator 22, and shift switch driving to the reverse position (R) by the shift operating device 23 is started.

Here, even when a shift operation of the shift actuator 22 from the neutral position to the reverse position is detected and when the engine rotational speed is equal to or lower than the prescribed value, the shift actuator 22 is not driven when the throttle opening is equal to or larger than a certain value, and the shift actuator 22 is driven to start shift switch driving by the shift operating device 23 when the throttle opening becomes equal to or smaller than the certain value.

Even when the engine rotational speed is equal to or lower than a prescribed value, the engine rotational speed of the engine 30 may rapidly increase after shifting if the throttle is open. With the above-described configuration, however, a shift-in in such a case can be avoided and damage of the reverse gear 40, etc., and an abrupt movement of the boat can be prevented.

While the shift actuator 22 is driven only if the engine rotational speed is equal to or lower than a prescribed value when the remote control shift lever 18 is shifted from the neutral position to the reverse position in the present preferred embodiment, the present invention is not limited thereto. The shift actuator 22 may be driven when the boat speed is equal to or lower than a prescribed value or when the propeller shaft rotational speed is equal to or lower than a prescribed value.

In this case, a signal from the boat speed sensor 68 or the propeller shaft rotational speed sensor is inputted into the control microcomputer 64 and the switch controller 71 performs the control process.

When the boat speed is higher than the prescribed value, the rotational speed of the propeller 33 is high and quick shifting causes a large shock. Thus, in this case as well, the shift actuator 22 is not driven to prevent a shock being applied between the reverse gear 40, the pinion 41, and the dog clutch 42 as in the first preferred embodiment. As a result, damage of the reverse gear, 40, etc., and an abrupt movement of the boat can be prevented.

In this case, when the failure detector 73 detects a failed state of the boat speed sensor 68 or the propeller shaft rotational speed sensor 77 and a failure detection signal is inputted into the switch controller 71, the switch controller 71 drives the shift actuator 22 according to the operative position of the remote control shift lever 18 so that normal shift switch driving by the shift operating device 23 can be made even when the shift detector 70 detects a shift operation of the remote control shift lever 18 from the forward position through the neutral position to the reverse position, or vice-versa, and when the boat speed or the propeller shaft rotational speed is higher than a prescribed value (the value is not accurate because of the failure).

Therefore, even when the sensor 68 or 77 has failed and the boat speed cannot be measured, a minimum shift driving operation can be carried out.

In addition, the shift actuator 22 may be driven when the engine rotational speed and the boat speed or the propeller shaft rotational speed are equal to or lower than the respective prescribed values.

Moreover, a throttle valve (not shown) and a throttle actuator 75 for opening and closing the throttle valve are provided, and a throttle control device 76 for controlling the operation of the throttle actuator 75 is provided as shown in FIG. 6.

The throttle control device 76 may control the throttle actuator 75 so as not to operate until a signal from the shift detector 70 arranged to detect completion of shifting is inputted into the throttle control device 76 and shifting is completed.

In this case, a quick increase in the engine rotational speed of the engine 30 can be prevented and a shift-in at a high engine rotational speed condition can be avoided. As a result, damage of the reverse gear 40, etc., and a rapid movement of the boat can be prevented.

Figure 9:
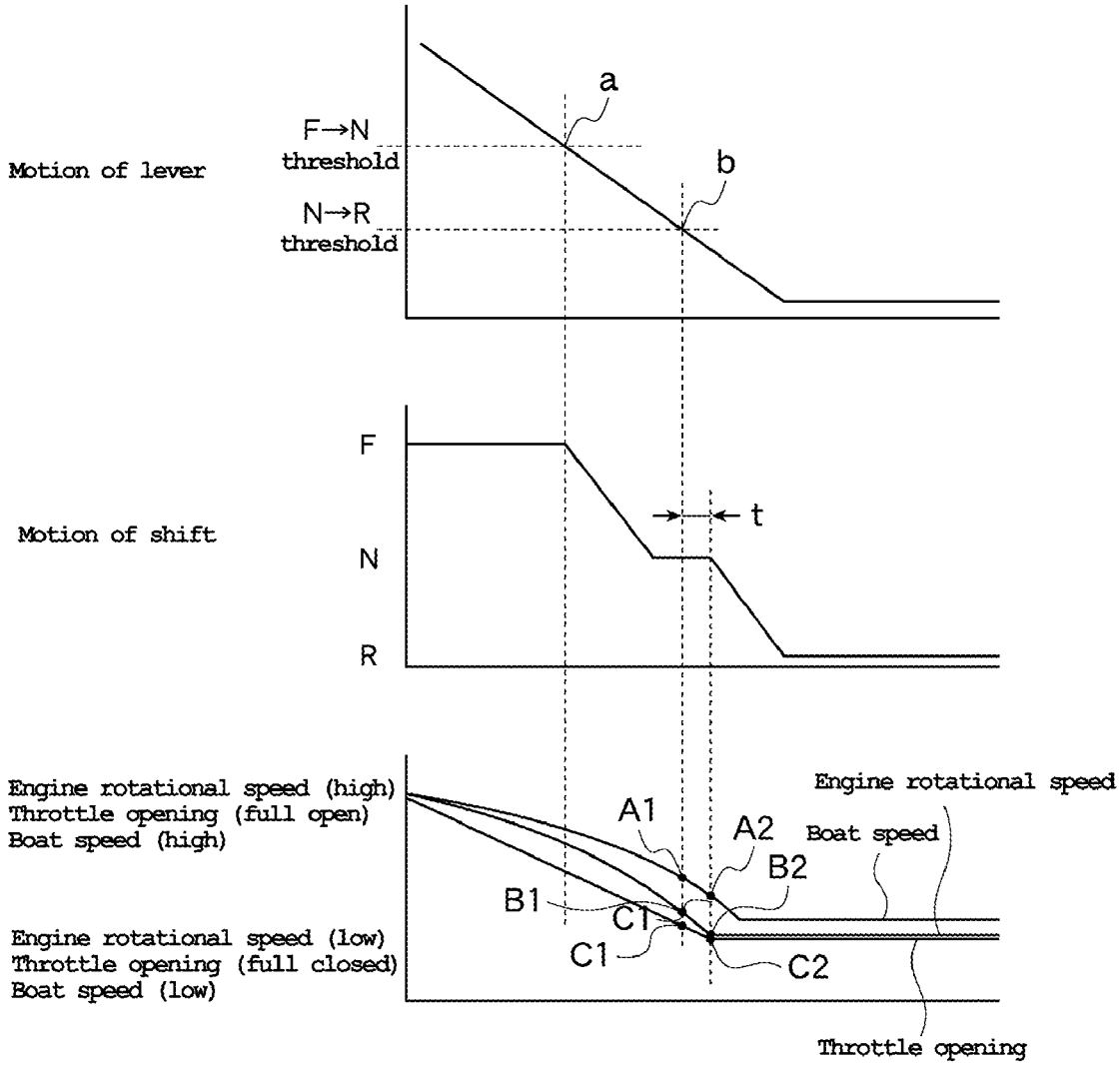
FIG. 9 is a graph chart illustrating a function of the boat according to the first preferred embodiment of the present invention.

Referring now to FIG. 9, the relationship among the motion of the remote control shift lever 18, the motion of the shift, the engine rotational speed, the boat speed, and the throttle opening when a quick shift operation to the reverse position is performed is described. Of course, the same process may apply from a quick shift operation from the reverse position to the forward position.

When the remote control shift lever 18 is rotated from the forward position (F) toward the neutral position (N) and the lever 18 reaches a threshold (a) between the forward position (F) and the neutral position (N), a signal from the potentiometer 19 is transmitted to the control microcomputer 64, and the shift actuator 22 is driven to accomplish shifting from the forward position (F) to the neutral position (N) (shift out).

When the remote control shift lever 18 is further rotated from the neutral position (N) toward the reverse position (R) and the lever 18 reaches a threshold (b) between the neutral position (N) and the reverse position (R), a signal from the potentiometer 19 is transmitted to the control microcomputer 64. If the boat speed A1, the engine rotational speed B1, and the throttle opening C1 at this time are greater than respective prescribed values, the switch controller 71 stops driving the shift actuator 22 for a time period (t) to maintain the state of the neutral position (N).

Then, when the boat speed, the engine rotational speed, and the throttle opening reach A2, B2, and C2, respectively, which are equal to or lower than the respective prescribed values, the shift actuator 22 is driven by the switch controller 71 to accomplish shifting from, for example, the neutral position (N) to the reverse position (R) (shift-in).

Second Preferred Embodiment

The second preferred embodiment is different from the first preferred embodiment in the method of controlling the switch controller 71.

That is, the switch controller 71 does not drive the shift actuator 22 when the shift detector 70 detects a shifting from the neutral position to the forward position or the reverse position and the engine rotational speed detected by the engine rotational speed sensor 67 is equal to or higher than a prescribed value, and does drive the shift actuator 22 and controls the shift operating device 23 to start shift switch driving to the reverse position or the forward position when the engine rotational speed decreases to a value equal to or smaller than the prescribed value as in the first preferred embodiment.

In the second preferred embodiment, the prescribed value of the engine rotational speed is changed based on the boat speed detected by the boat speed sensor 68. When the boat speed is low, the prescribed value is increased to a value larger than that which is used when the boat speed is high.

In this configuration, since the prescribed value of the engine rotational speed is increased to a larger value when the boat speed is low, frequent shift-in or shift-out for adjustment of the boat position required to, for example, put the boat ashore can be accomplished reliably.

The other features and functions preferably are the same as those of the first preferred embodiment and hence redundant description is omitted.

While the outboard motor 11 is described as a boat propulsion unit in the above preferred embodiments, the present invention is not limited thereto. An inboard-outboard motor or the like may be used as the boat propulsion unit. Also, while shift control is performed when a shift operation from the forward position through neutral position to the reverse position is done, the present invention is not limited thereto. The present invention is applicable to shift operations from the neutral position to the forward position. When a quick shift-in is performed when the remote control shift lever 18 is in the neutral position and the engine rotational speed is high, a shock is generated. Therefore, the preferred embodiments of the present invention are also effective in such a case.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

a shift operating device arranged to shift between forward, neutral, and reverse positions according to an operation signal from a remote control;

a shift actuator arranged to drive the shift operating device;

an engine arranged to rotate a propeller; and a controller arranged to receive the operation signal from the remote control and to control operation of the shift actuator based on the operation signal; wherein when the controller receives the operation signal from the remote control and the operation signal is a signal commanding a shift operation from the neutral position to the forward position or the reverse position, the controller does not drive the shift actuator to shift from the neutral position to the forward position or the reverse position when an engine rotational speed is higher than a prescribed value therefor.

2. The boat propulsion unit according to claim 1, wherein the controller drives the shift actuator to shift from the neutral position to the forward position or the reverse position when both the engine rotational speed is equal to or lower than the prescribed value and a boat speed or a propeller shaft rotational speed is equal to or lower than a prescribed value.

3. The boat propulsion unit according to claim 1, wherein when the controller receives the operation signal from the remote control and the operation signal is a signal commanding a shift operation from the forward position through the neutral position to the reverse position, the controller drives the shift actuator to shift from the neutral position to the reverse position when the engine rotational speed is equal to or lower than the prescribed value therefor.

4. The boat propulsion unit according to claim 1, further comprising a throttle, wherein the controller does not drive the shift actuator when a throttle opening is equal to or greater than a prescribed value even when the engine rotational speed is equal to or lower than the prescribed value therefor, and does drive the shift actuator to shift from the neutral position to the forward position or the reverse position when the throttle opening becomes smaller than the prescribed value.

5. The boat propulsion unit according to claim 1, further comprising a failure detector arranged to detect a failed state of a sensor arranged to detect the engine rotational speed, wherein when a failure is detected, the shift actuator is driven according to the operation signal from the remote control to accomplish normal shifting by the shift operating device even when the shift operation from the neutral position to the forward position or the reverse position is detected.

6. The boat propulsion unit according to claim 1, further comprising a throttle valve and a throttle actuator arranged to open and close the throttle valve, a throttle control device arranged to control operation of the throttle actuator, and a shift detector arranged to detect completion of shifting, wherein the throttle control device controls the throttle actuator not to operate until the shifting is completed.

7. A boat comprising a boat propulsion unit according to claim 1.

8. A boat having a plurality of boat propulsion units, wherein at least one of the plurality of boat propulsion units is a boat propulsion unit according to claim 1.

9. A boat propulsion unit comprising:

a shift operating device arranged to shift between forward, neutral, and reverse positions according to an operation signal from a remote control;

a shift actuator arranged to drive the shift operating device;

an engine arranged to rotate a propeller; and a controller which receives an operation signal from the remote control and controls operation of the shift actuator based on the operation signal; wherein when the controller receives the operation signal from the remote control and the operation signal is a signal commanding a shift operation from the neutral position to the forward position or the reverse position, the controller drives the shift actuator to shift from the neutral position to the forward position or the reverse position when an engine rotational speed is equal to or lower than a prescribed value; and the prescribed value of the engine rotational speed can be changed depending on a boat speed, and the prescribed value of the engine rotational speed is a greater value for a high boat speed than for a low boat speed.

10. The boat propulsion unit according to claim 9, wherein the boat speed is estimated and calculated from an intake pressure to the engine and the engine rotational speed.

11. The boat propulsion unit according to claim 9, further comprising a throttle valve and a throttle actuator arranged to open and close the throttle valve, a throttle control device arranged to control operation of the throttle actuator, and a shift detector arranged to detect completion of shifting, wherein the throttle control device controls the throttle actuator not to operate until the shifting is completed.

12. A boat comprising a boat propulsion unit according to claim 9.

13. A boat having a plurality of boat propulsion units, wherein at least one oft plurality of boat propulsion units is a boat propulsion unit according to claim 9.

14. A boat propulsion unit comprising:

a shift operating device arranged to shift between forward, neutral, and reverse positions according to an operation signal from a remote control;

a shift actuator arranged to drive the shift operating device;

an engine arranged to rotate a propeller; and a controller arranged to receive the operation signal from the remote control and to control operation of the shift actuator based on the operation signal; wherein when the controller receives the operation signal from the remote control and the operation signal is a signal commanding a shift operation from the neutral position to the forward position or the reverse position, the controller does not drive the shift actuator to shift from the neutral position to the forward position or the reverse position when a boat speed is higher than a prescribed value therefor.

15. The boat propulsion unit according to claim 14, further comprising a boat speed sensor, wherein the boat speed is detected by the boat speed sensor.

16. The boat propulsion unit according to claim 14, wherein the boat speed is estimated or calculated from an intake pressure to the engine and an engine rotational speed.

17. A boat propulsion unit comprising:

a shift operating device arranged to shift between forward, neutral, and reverse positions according to an operation signal from a remote control;

a shift actuator arranged to drive the shift operating device;

an engine arranged to rotate a propeller; and a controller arranged to receive the operation signal from the remote control and to control operation of the shift actuator; wherein when the controller receives the operation signal from the remote control and the operation signal is a signal commanding a shift operation from the neutral position to the forward position or the reverse position, the controller does not drive the shift actuator to shift from the neutral position to the forward position or the reverse position when a propeller shaft rotational speed is higher than a prescribed value therefor.

18. The boat propulsion unit according to claim 14, wherein the controller drives the shift actuator to shift from the neutral position to the forward position or the reverse position when both the boat speed is equal to or lower than the prescribed value and an engine rotational speed is equal to or lower than a prescribed value.

19. The boat propulsion unit according to claim 14, wherein when the controller receives the operation signal from the remote control and the operation signal is a signal commanding a shift operation from the forward position through the neutral position to the reverse position, the controller drives the shift actuator to shift from the neutral position to the reverse position when the boat speed is equal to or lower than the prescribed value therefor.

20. The boat propulsion unit according to claim 14, further comprising a throttle, wherein the controller does not drive the shift actuator when a throttle opening is equal to or greater than a prescribed value even when the boat speed is equal to or lower than the prescribed value therefor, and does drive the shift actuator to shift from the neutral position to the forward position or the reverse position when the throttle opening becomes smaller than the prescribed value.

21. The boat propulsion unit according to claim 14, further comprising a failure detector arranged to detect a failed state of a sensor arranged to detect the boat speed, wherein when a failure is detected, the shift actuator is driven according to the operation signal from the remote control to accomplish normal shifting by the shift operating device even when the shift operation from the neutral position to the forward position or the reverse position is detected.

22. The boat propulsion unit according to claim 14, wherein the boat speed is estimated and calculated from an intake pressure to the engine and an engine rotational speed.

23. The boat propulsion unit according to claim 14, further comprising a throttle valve and a throttle actuator arranged to open and close the throttle valve, a throttle control device arranged to control operation of the throttle actuator, and a shift detector arranged to detect completion of shifting, wherein the throttle control device controls the throttle actuator not to operate until the shifting is completed.

24. A boat comprising a boat propulsion unit according to claim 14.

25. A boat having a plurality of boat propulsion units, wherein at least one of the plurality of boat propulsion units is a boat propulsion unit according to claim 14.

26. The boat propulsion unit according to claim 17, wherein the controller drives the shift actuator to shift from the neutral position to the forward position or the reverse position when both the propeller shaft rotational speed is equal to or lower than the prescribed value and an engine rotational speed is equal to or lower than a prescribed value.

27. The boat propulsion unit according to claim 17, wherein when the controller receives the operatic), signal from the remote control and the operation signal is a signal commanding a shift operation from the forward position through the neutral position to the reverse position, the controller drives the shift actuator to shift from the neutral position to the reverse position when the propeller shaft rotational speed is equal to or lower than the prescribed value therefor.

28. The boat propulsion unit according to claim 17, further comprising a throttle, wherein the controller does not drive the shift actuator when a throttle opening is equal to or greater than a prescribed value even when the propeller shaft rotational speed is equal to or lower than the prescribed value therefor, and does drive the shift actuator to shift from the neutral position to the forward position or the reverse position when the throttle opening becomes smaller than the prescribed value.

29. The boat propulsion unit according to claim 17, further comprising a failure detector arranged to detect a failed state of a sensor arranged to detect the propeller shaft rotational speed, wherein when a failure is detected, the shift actuator is driven according to the operation signal from the remote control to accomplish normal shifting by the shift operating device even when the shift operation from the neutral position to the forward position or the reverse position is detected.

30. The boat propulsion unit according to claim 17, further comprising a throttle valve and a throttle actuator arranged to open and close the throttle valve, a throttle control device arranged to control operation of the throttle actuator, and a shift detector arranged to detect completion of shifting, wherein the throttle control device controls the throttle actuator not to operate until the shifting is completed.

31. A boat comprising a boat propulsion unit according to claim 17.

32. A boat having a plurality of boat propulsion units, wherein at least one of the plurality of boat propulsion units is a boat propulsion unit according to claim 17.

* * * * *